US009164433B2

(12) United States Patent
Kudo

(10) Patent No.: US 9,164,433 B2
(45) Date of Patent: Oct. 20, 2015

(54) IMAGE FORMING APPARATUS

(71) Applicant: CANON KABUSHIKI KAISHA, Tokyo (JP)

(72) Inventor: Ran Kudo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/209,906

(22) Filed: Mar. 13, 2014

(65) Prior Publication Data

US 2014/0270840 A1 Sep. 18, 2014

(30) Foreign Application Priority Data

Mar. 15, 2013 (JP) ..... 2013-052679

(51) Int. Cl.
*G03G 15/16* (2006.01)

(52) U.S. Cl.
CPC .... *G03G 15/161* (2013.01); *G03G 2215/00156* (2013.01); *G03G 2215/0132* (2013.01)

(58) Field of Classification Search
USPC ..... 399/101
See application file for complete search history.

(56) References Cited

U.S. PATENT DOCUMENTS

2007/0110471 A1* 5/2007 Kitamura ..... 399/101

FOREIGN PATENT DOCUMENTS

| | | | |
|---|---|---|---|
| JP | 9-169449 | A | 6/1997 |
| JP | 2001-146335 | A | 5/2001 |
| JP | 2001-520611 | A | 10/2001 |

* cited by examiner

*Primary Examiner* — Clayton E LaBalle
*Assistant Examiner* — Jas Sanghera
(74) *Attorney, Agent, or Firm* — Canon U.S.A., Inc. IP Division

(57) ABSTRACT

An image forming apparatus is provided. A backup face disposed on an upward face of the control box makes contact with a backup reception part that is disposed on a downward face of a belt cleaning device, and supports a steering roller and cleaning blade. The backup face reduces the force that acts on the frame stay and so forth, following the sliding friction of the intermediate transfer belt and cleaning blade. The backup reception part and backup reception part are formed so that even if the steering roller moves in the tension application direction, the predetermined contact state can be maintained.

14 Claims, 13 Drawing Sheets

IMAGE FORMING APPARATUS

BACKGROUND OF THE INVENTION

1. Field of the Invention

The present invention relates to an image forming apparatus.

2. Description of the Related Art

An image forming apparatus that forms a toner image and transfers this to a recording medium, heats and pressurizes the recording medium onto which the toner image is transferred, and fixes the image to the recording medium, is widely used. There are cases wherein the image forming apparatus has a belt member (intermediate transfer belt, recording medium conveying belt, transfer belt, fixing belt, and pressurizing belt) that is steering-controlled by tilting a steering roller).

A belt steering control is generally a forced steering method in which a lateral position of a belt member is detected by a sensor, and the steering roller is forcibly tilted from the outside by a motor, based on the detection results thereof (Japanese Patent Laid-Open No. 9-169449). However, an autonomic steering method is also in use, wherein the steering roller is supported so as to be tiltable, and the steering roller can autonomously tilt and steer the belt member according to the lateral position of the belt member, without being driven externally (Japanese Patent Laid-Open No. 2001-146335 and PCT Japanese Translation Patent Publication No. 2001-520611).

The image forming apparatus disclosed in PCT Japanese Translation Patent Publication No. 2001-520611 has a pair of steering roller supporting members disposed tiltably on a frame member that rotatably supports a driving roller member. Both edges of the steering roller member are affixed rotatably to the pair of steering roller supporting members. Upon the belt member moving laterally, the rotating load momentum on the left and right of the steering roller member, of which a rotational axis of the steering roller supporting member is the center, is changed, and the steering roller member autonomously tilts and laterally moves the belt member.

In the image forming apparatus according to PCT Japanese Translation Patent Publication No. 2001-520611, a rotating shaft that tiltably supports a pair of steering roller supporting members bears the weight of the steering roller supporting members and the steering roller member by itself. Also, the rotating shaft of the steering roller supporting member bears by itself the force of the rotating load of the belt member, which occurs at the steering roller member, which urges the steering roller supporting member downstream in the rotating direction of the belt member. Therefore, the rotating shaft of the steering roller supporting member and the configuration that supports this rotating shaft on a frame member, have a considerable amount of rigidity.

Particularly, in a case wherein a belt cleaning device in which a cleaning blade abuts against a belt member supported on the steering roller is provided to a steering roller, the sliding load of the cleaning blade becomes the rotating load of the belt member. This load strongly urges the steering roller downstream in the rotating direction of the belt member, and applies a large bending force to the rotating shaft of the steering roller supporting members.

SUMMARY OF THE INVENTION

An image forming apparatus includes: an endless belt member; a driving roller configured to stretch and drive the belt member; a steering roller configured to stretch the belt member, at a position away from the driving roller, and to rotate following the belt member; a steering roller supporting unit configured to rotatably support the steering roller; a cleaning unit, including a cleaning member that abuts against the belt member at a position facing the steering roller and cleans the belt member, configured to be supported by the steering roller supporting unit which rotatably supports the steering roller; a frame member; a first supporting mechanism that is disposed on the frame member, and tiltably supports the steering roller and the cleaning unit on a predetermined rotational axis that is perpendicular to the rotational axis of the steering roller; and a second supporting mechanism that tiltably supports the cleaning unit on the predetermined rotational axis, so as to reduce the force applied to the first supporting mechanism caused by the movement of the belt member.

Further features of the present invention will become apparent from the following description of exemplary embodiments with reference to the attached drawings.

DESCRIPTION OF THE EMBODIMENTS

Embodiments of the present invention will be described in detail below with reference to the appended diagrams.

First Embodiment

Image Forming Apparatus

Figure 1:
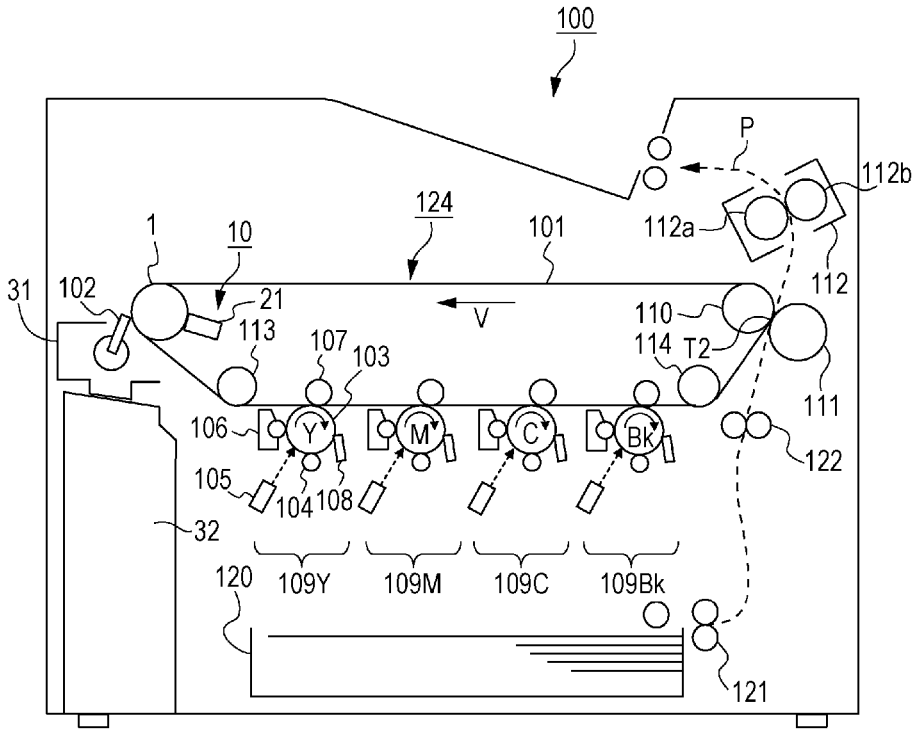
FIG. 1 is an explanatory view of a configuration of an image forming apparatus.

FIG. 1 is an explanatory view of a configuration of an image forming apparatus. As illustrated in FIG. 1, an image forming apparatus 100 is a tandem intermediate transfer system full-color printer, in which image forming units 109Y, 109M, 109C, and 109Bk of yellow, magenta, cyan, and black are disposed along an intermediate transfer belt 101.

A yellow toner image is formed on a photosensitive drum 103 in the image forming unit 109Y, and transferred to the intermediate transfer belt 101. In the image forming unit 109M, a magenta toner image is formed with similar procedures as in the image forming unit 109Y, and is transferred so as to be layered on top of the yellow toner image on the intermediate transfer belt 101. In the image forming units 109C and 109Bk, a cyan toner image and a black toner image are formed with similar procedures as in the image forming unit 109Y, and transferred sequentially so as to be layered onto the intermediate transfer belt 101.

The four-color toner image borne by the intermediate transfer belt 101 is transported to a secondary transfer unit T2, and is subjected to secondary transfer to a recording medium P at one time. The recording medium fed out from a recording medium cassette 120, having been separated one by one by a separating roller 121, is transported to a registration roller 122. The registration roller 122 supplies the recording medium P to the secondary transfer unit T2 so as to match the timing with the toner image on the intermediate transfer belt.

The secondary transfer roller 111 comes into contact with the intermediate transfer belt 101 on a secondary transfer inner roller 110, so as to form the secondary transfer unit T2. A fixing device 112 heats and pressurizes the recording medium P with a nip portion of a fixing roller 112*a* and pressure roller 112*b* to fix the image on the recording medium P. The recording medium P, which has passed through the secondary transfer unit T2 and bearing the four-color toner image has been subjected to secondary transfer, is subjected to curvature separation from the intermediate transfer belt 101. The recording medium P is then sent into the fixing device 112, whereby the recording medium P onto which the image has been fixed in the fixing device 112 is discharged from the device.

Image Forming Unit

The image forming units 109Y, 109M, 109C, and 109Bk are substantially similar in configuration, other than the different toner colors of yellow, magenta, cyan, and black that are used in the respective developing devices. A toner image forming process for the yellow image forming unit 109Y will be described below, and duplicative descriptions relating to the other image forming units 109M, 109C, and 109Bk will be omitted.

The image forming unit 109Y disposes a charging roller 104, exposing device 105, developing device 106, primary transfer roller 107, and drum cleaning device 108, on the periphery of the photosensitive drum 103. The photosensitive drum 103 has a photoconductive layer formed on the surface thereof, and rotates in the direction of the arrows at a predetermined process speed. The charging roller 104 charges the surface of the photosensitive drum 103 to a uniform electric potential. The exposing device 105 scans a laser beam using a rotary mirror, so as to write in an electrostatic image of the image on the surface of the photosensitive drum 103.

The developing device 106 transfers toner to the photosensitive drum 103 and develops the electrostatic image into a toner image. The primary transfer roller 107 transfers the toner image onto which voltage has been applied and which has been borne on the photosensitive drum 103, to the intermediate transfer belt 101. The drum cleaning device 108 causes the cleaning blade to abut against the photosensitive drum 103, and collects the transfer residual toner that remains on the photosensitive drum 103.

Intermediate Transfer Unit

As illustrated in FIG. 1, the driving roller 110 stretches and drives the intermediate transfer belt 101, which is an example of an endless belt. A frame stay 8 is a portion of the frame member that rotatably supports the driving roller 110. An intermediate transfer unit 124, which is an example of an exchange unit, is integrally formed including the frame stay 8, intermediate transfer belt 101, driving roller 110, steering roller 1, tension rollers 113 and 114, and primary transfer roller 107. The intermediate transfer unit 124 is removable from the housing structure of the image forming apparatus 100.

The intermediate transfer belt 101 is stretched over the driving roller 110, steering roller 1, tension rollers 113 and 114, and primary transfer roller 107. The driving roller 110 also functions as a secondary transfer inner roller which forms a secondary transfer unit T2, by sandwiching the intermediate transfer belt 101 between itself and the secondary transfer roller 111. The steering roller 1 also functions as a tension roller that applies predetermined tensile force to the intermediate transfer belt 101.

The intermediate transfer belt 101 is made of a resin belt having a polyimide (PI) as a base layer thereof, where the tensile modulus of elasticity E=18,000N/cm2, and a thickness of 0.08 mm. It is desirable for the intermediate transfer belt 101 to be made of a resin having high rigidity, such as polyvinylidine fluoride (PVDF), polyamide, polyimide resin (PI), polyethylene terephthalate (PET), polycarbonate (PC), or the like. It is desirable for the thickness of the intermediate transfer belt 101 to be in the range of 0.02 mm to 0.50 mm. If the intermediate transfer belt 101 is too thin, sufficient resistance from abrasions are not obtained, and if too thick, the intermediate transfer belt 101 has difficulty bending at the driving roller 110, steering roller 1, tension rollers 113 and 114, whereby deformation and bending may occur.

Self-Steering Mechanism

Figure 2A:
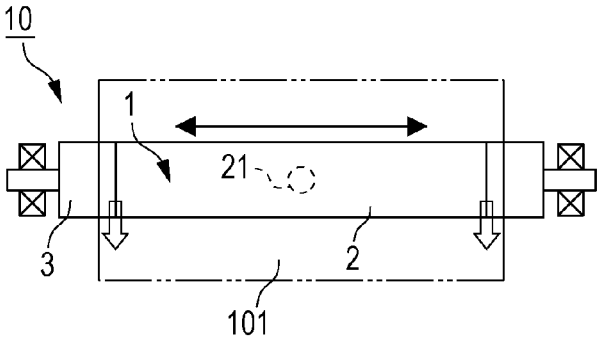
FIGS. 2A through 2C are explanatory views of action of a self-steering mechanism.
Figure 2B:
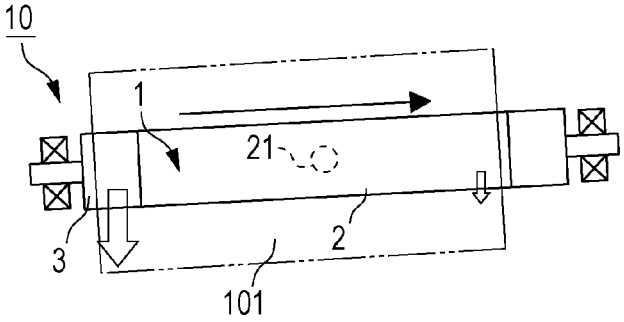
Figure 2C:
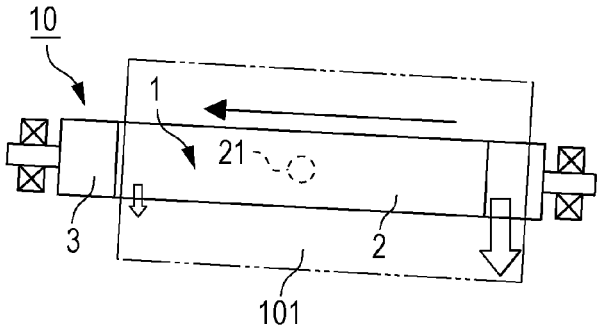
Figure 3:
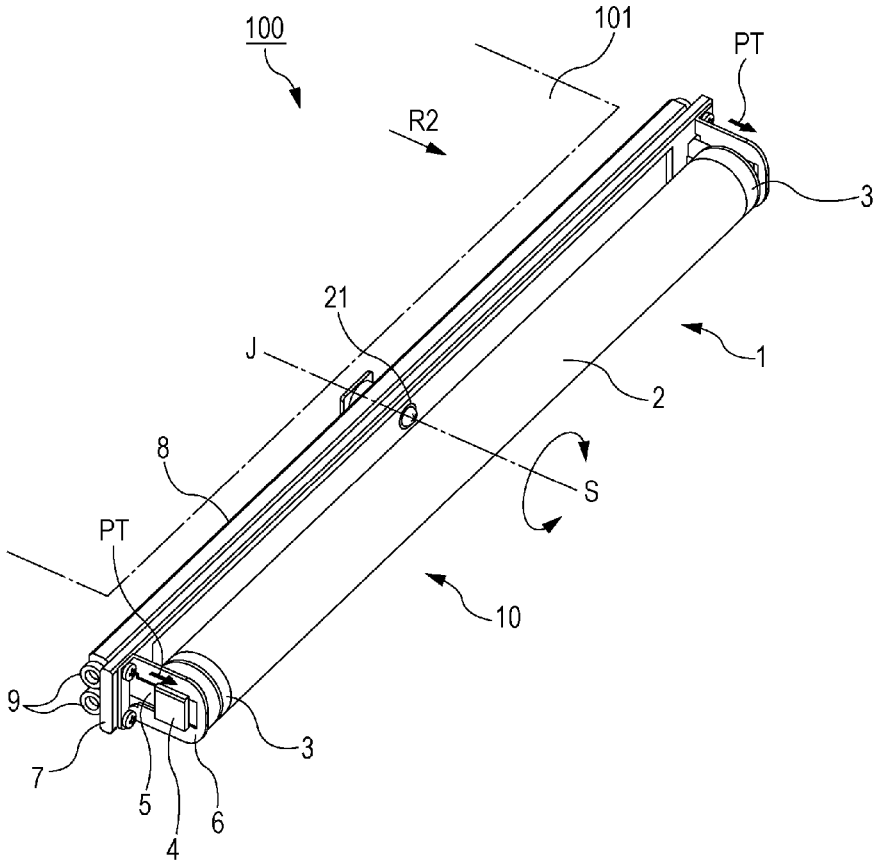
FIG. 3 is a perspective view of a self-steering mechanism.

FIGS. 2A through 2C are explanatory views of action of a self-steering mechanism. FIG. 3 is a perspective view of a self-steering mechanism.

As illustrated in FIG. 2A, the steering roller 1 of the self-steering mechanism 10 autonomously tilts based on the balance of friction on both end portions, and laterally moves the intermediate transfer belt 101. The steering roller 1 is rockably supported with the rotating shaft 21 in the center thereof. In the case that both ends of the intermediate transfer belt 101 run over the left and right sliding rings 3, the left and right friction is equal, and the steering roller 1 does not tilt. As illustrated in FIGS. 2B and 2C, upon a lateral movement occurring to the intermediate transfer belt 101 resulting from an external force, the steering roller 1 tilts in a necessary direction only as much as is needed, and returns the intermediate transfer belt 101 to the state in FIG. 2A.

As illustrated in FIG. 2B, upon a lateral movement occurring to the intermediate transfer belt 101 in the left direction, the intermediate transfer belt 101 runs widely over the left sliding ring portion 3 and the friction on the left side increases, whereby the steering roller 1 tilts in the direction of lowering the left side. Consequently, one-sided moving force in the right direction is applied to the intermediate transfer belt 101 that is wrapped around the steering roller 1.

As illustrated in FIG. 2C, upon a lateral movement occurring to the intermediate transfer belt 101 in the right direction, the intermediate transfer belt 101 runs widely over the right sliding ring portion 3 and the friction on the right side increases, whereby the steering roller 1 tilts in the direction of lowering the right side. Consequently, one-sided moving force in the left direction is applied to the intermediate transfer belt 101 that is wrapped around the steering roller 1.

As illustrated in FIG. 3, the steering roller 1 is a driven roller 2 of which the center portion excepting both end portions is rotatable. The driven roller 2 rotates following the rotation of the intermediate transfer belt 101. On the other hand, the end portions of the steering roller 1 are sliding ring portions 3 wherein rotation is restricted. The sliding ring portions 3 rubs the intermediate transfer belt 101, following the rotation of the intermediate transfer belt 101, and generates friction resistance.

A side supporting member 6 stands on both end portions of the rotating plate 7. The rotating plate 7 and the side supporting members 6 make up a supporting base that supports the steering roller 1. A sliding bearing 4 fits into a sliding groove formed on the side supporting member 6, and is movable in the direction of the arrows PT. The sliding bearing 4 rotatably supports the end portions of the rotating shaft of the steering roller 1. A tension spring (compression spring) 5 biases the sliding bearing 4 in the direction of the arrows PT. The end portions of the steering roller 1 are biased by the tension spring 5, so as to apply tension to the intermediate transfer belt 101.

The turning plate 7 is turnable in the direction of the arrow S, in relation to the center rotational axis J. As illustrated in FIG. 7B, the frame stay 8 is a member that bridges over side plates 8F of the intermediate transfer unit 124, and makes up the unit frame. As illustrated in FIG. 3, the frame stay 8 has a sliding roller 9. The sliding roller 9 reduces the rotational resistance of the rotation plate 7 on the frame stay 8.

First Supporting Unit

Figure 4:
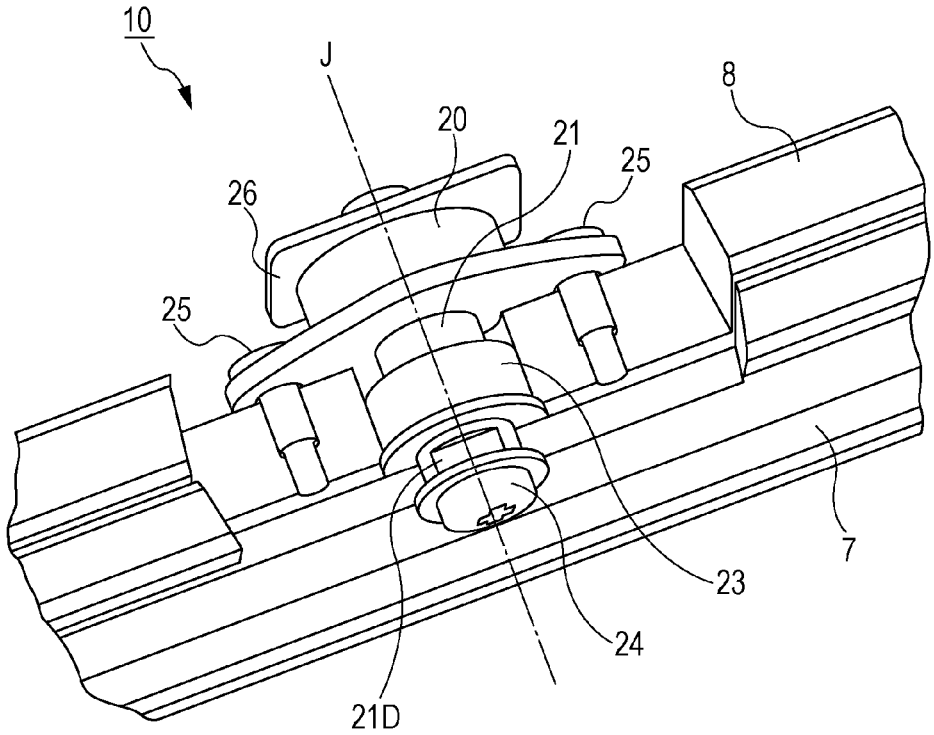
FIG. 4 is a perspective view of a rotation center of a self-steering mechanism.

FIG. 4 is a perspective view of a turning center portion of a self-steering mechanism. As illustrated in FIG. 4, a rotation shaft 21 of the turning plate 7 is fit into the center portion of the turning plate 7, and is integrated into one unit with a screw 24. A parallel face 21D is formed on one end portion of the rotation shaft 21, and at the time of building the unit, the parallel face 21D is secured with a tool and the rotation shaft 21 is retained from rotating. The rotation shaft 21 is inserted into the bearing 23 (ball bearing) fixed in the frame stay 8 and is rotatably supported. A retaining member 26 is fixed to the other end portion of the rotation shaft 21. The rotation shaft 21 serves as the center axis of a rotary damper 20. The rotary damper 20 is fixed to the center position of the frame stay 8 with a screw 25.

The rotary damper 20 is a mechanical element that uses the viscosity of oil to generate rotating resistance, and greatly increases the rotating resistance according to the shearing speed generated by the rotation shaft 21. As the time change rate of the rocking speed of the rotation shaft 21 increases, the rotating resistance of the rotary damper 20 increases, whereby noise portions of the rocking components of the steering roller 1 are cut, and the steering action of the intermediate transfer belt 101 by the steering roller 1 is stabilized.

Sliding Ring Portion

Figure 5A:
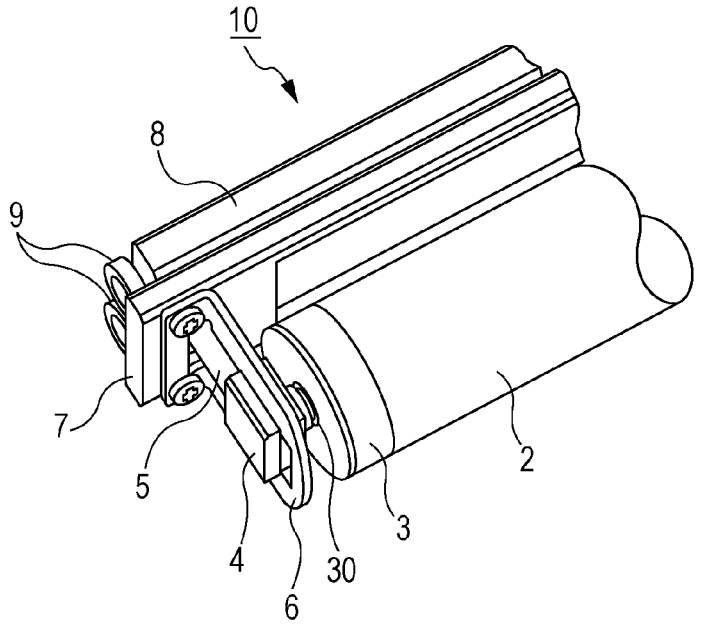
FIGS. 5A and 5B are perspective views of an end portion of a steering roller.
Figure 5B:
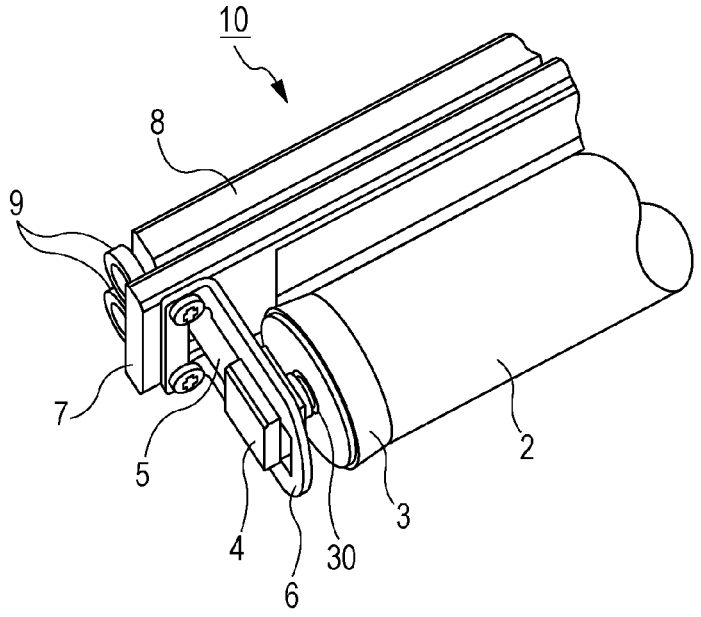
Figure 6A:
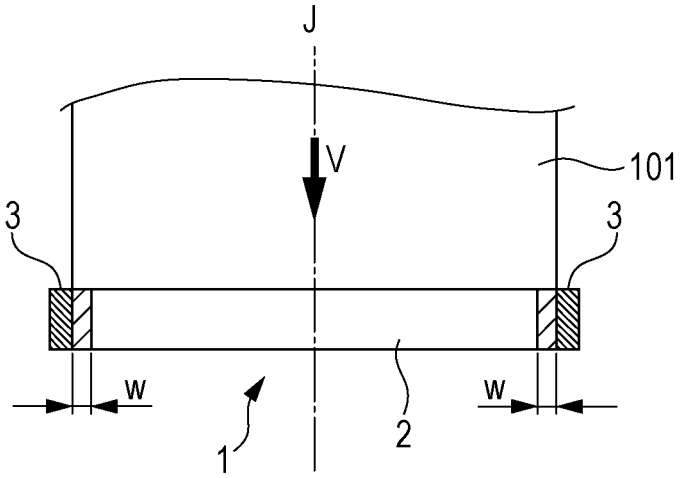
FIGS. 6A and 6B are explanatory views of the running width of an intermediate transfer belt on the steering roller.
Figure 6B:
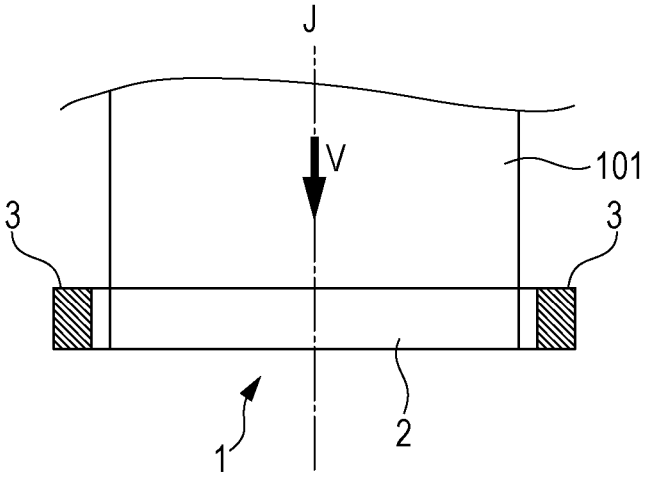

FIGS. 5A and 5B are perspective views of an end portion of a steering roller. FIGS. 6A and 6B are explanatory views of running width of an intermediate transfer belt corresponding to the steering roller.

As illustrated in FIG. 5A, the sliding ring portion 3 has a straight form having an even external diameter distribution in the roller axis direction. In the case that the sliding ring portion 3 is in a straight form, it is desirable to set the static friction coefficient μs of the sliding ring portion 3 to approximately μs=0.6. The sliding ring portion 3 is formed with a resin material such as polyacetal (POM) or the like that has sliding friction durability. The resin material is provided conductivity, taking into consideration static harm by the frictional charge with the intermediate transfer belt 101. The end portion of the steering roller shaft 30 has a D-cut shape, thereby being inhibited from rotating as to the sliding bearing 4. The sliding ring portion 3 attached to the steering roller shaft 30 in a non-rotatable manner.

On the other hand, the following roller 2 is formed with an aluminum cylindrical material. The following roller 2 is rotatably supported as to the steering roller shaft 30 by a built-in bearing member. The end portions of the steering roller 1 are set in a non-rotatable manner, and the inner side portions of both ends are set to be rotatable, whereby resistance load on the end portions as to the rotation of the intermediate transfer belt 101 is significantly higher than the center portion.

Accordingly, upon the intermediate transfer belt 101 that is stretched over the steering roller 1 rotating, the following roller 2 of the steering roller 1 does not generate sliding friction as to the inner circumferential surface of the belt. However, the sliding ring portion 3 of the steering roller 1 slides as to the intermediate transfer belt 101 and causes great friction force. The friction coefficient of the sliding ring portion 3 and following roller 2 are measured using a JIS K7125 plastic-film and sheet-friction coefficient testing method, with the polyimide sheet, which is the material of the inner circumferential surface of the intermediate transfer belt 101, as a test piece.

Note that as illustrated in FIG. 5B, the sliding ring portion 3 may be of a taper form, in which the outside diameter continuously becomes larger toward the outer side in the roller axis direction. In the case of using a taper form, in which the farther the end portions of the steering roller 1 are toward the outside the greater the diameter is, mechanical feedback is less readily influenced by frictional change between the steering roller 1 and the intermediate transfer belt 101, whereby the cancelling effect of autonomous lateral movement is stabilized. Therefore, in the case that the sliding ring portion 3 is of a taper form, the static friction coefficient μs may be reduced more than in the case of a straight form. Specifically, approximately μs=0.3 is desirable for a taper angle of $\phi=8°$.

Also, the sliding ring portion 3 is not restricted to a configuration of being fixed so as to not rotate in the rotating direction of the following roller 2, and a configuration may be such that the sliding ring portion 3 is rotatable. However, in the case of being rotatable, the torque needed in order to enable the sliding ring portion 3 to rotate in the rotating direction of the intermediate transfer belt 101, has to be greater than the torque needed in order to enable the following roller 2 to rotate in the same direction.

As illustrated in FIG. 6A, the width of the intermediate transfer belt 101 is wider than the width of the following roller 2, and is narrower than the width of the steering roller 1 (following roller 2+sliding ring portion 3 of both ends). The intermediate transfer belt 101 and the sliding ring portion 3 have an equal running width w (the hatched portion in FIG. 6A). Therefore, the intermediate transfer belt 101 causes sliding friction with one of the sliding ring portions 3.

Conversely, as illustrated in FIG. 6B, in the case that the width of the intermediate transfer belt 101 is narrower than the width of the following roller 2, even if lateral movement occurs to the intermediate transfer belt 101, the steering roller 1 does not tilt to the point that there is an overlap width on the sliding ring portion 3. Therefore, in the instant that an overlap width exists, sudden tilting and lateral movement may occur, causing the lateral control of the intermediate transfer belt 101 to readily become unstable.

Belt Cleaning Device

Figure 7A:
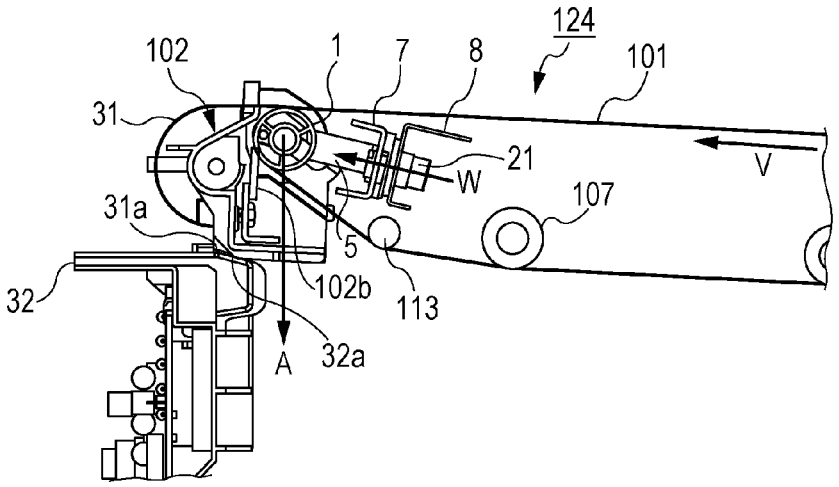
FIGS. 7A and 7B are explanatory views of a configuration of a belt cleaning device.
Figure 7B:
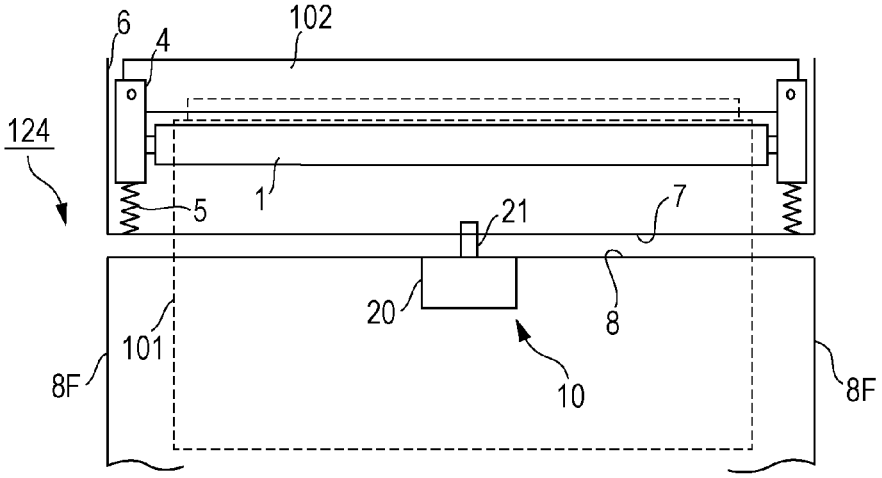

FIGS. 7A and 7B are explanatory views of a configuration of a belt cleaning device. As illustrated in FIGS. 7A and 7B, a belt cleaning device 102 causes a cleaning blade 102*b* to abut against the intermediate transfer belt 101, and collects the remaining transfer toner. The cleaning blade 102*b* abuts against the position where the intermediate transfer belt 101 moves downward.

As illustrated in FIG. 7A, the cleaning blade 102*b* is disposed in the counter direction as to the movement direction of the intermediate transfer belt 101 of which the inner side face is supported by the steering roller 1. The belt cleaning device 102 causes the tip portion of the cleaning blade 102*b* to abut against the outer said face of the intermediate transfer belt 101, collects the remaining toner and so forth that remains on the intermediate transfer belt 101 without having been transferred to the recording medium P. The cleaning blade 102*b* is made of urethane rubber. The hardness of the urethane rubber is approximately 75 degrees in terms of JIS-A hardness, and the thickness of the urethane rubber is 2 mm. The abutting angle of the cleaning blade 102*b* is 25°, and the abutting pressure is 3N/m (30 gf/cm). However, the present invention is not restricted to these.

As illustrated in FIG. 7B, the turning plate 7 is turnable as to the frame stay 8, with the rotating shaft 21 in the center thereof. The end portions of the belt cleaning device 102 are turnably attached to the slide bearings 4. The slide bearings 4 rotatably support the end portions of the steering roller 1, and can be moved along the side supporting member 6 which is fixed to the turning plate 7.

The belt cleaning device 102 and the steering roller 1 can change the intersection angle as to the side supporting member 6 while remaining parallel with each other. The belt cleaning device 102 tilts, as an integrated unit with the steering roller 1, and presses the tip of the cleaning blade 102*b* via the intermediate transfer belt 101 at a constant position of the steering roller 1. The cleaning blade 102*b* is disposed so as to constantly remain parallel as to the steering roller 1, and secures a friction state over the entire length of the abutment of the cleaning blade 102*b* as to the intermediate transfer belt 101. The abutting state of the intermediate transfer belt 101 and the cleaning blade 102*b* is maintained uniform and collection of the remaining transfer toner is performed, even while lateral movement is occurring to the intermediate transfer belt 101 and while the steering roller 1 is tilted.

Problem with Autonomous Steering Method

Now, as illustrated in FIG. 7A, upon the image forming starting, conveyance of the intermediate transfer belt 101 in the arrow V direction begins. Subsequently, the cleaning blade 102*b* that abuts against the intermediate transfer belt 101 receives force in the conveyance direction of the intermediate transfer belt 101, from frictional force. Simultaneously, the belt cleaning device 102 onto which the cleaning blade 102*b* is affixed also receives force in the conveyance direction of the intermediate transfer belt 101. The end portions of the belt cleaning device 102 are affixed to the slide bearings 4 of the steering roller 1, whereby the steering roller 1 and turning plate 7 receive bending force in the arrow A direction from the belt cleaning device 102. Upon the rotating shaft 21 and frame stay 8 being deformed under bending force, the steering roller 1 and turning plate 7 are lowered, and desired tension with the intermediate transfer belt 101 is not attained, leading to image defects. In order to provide a larger space between the peripheral parts so as not to make contact even when lowered, the size of the image forming apparatus 100 is increased.

Now, in the following embodiment, the bottom face of a toner collecting vessel 31 of the belt cleaning device 102 is abutted against, and supports, a control box 32 that is provided to the image forming apparatus 100. By allocating the force to be applied to the rotating shaft 21 and frame stay 8 to the control box 32, the load on the rotating shaft 21 and frame stay 8 is reduced.

Configuration Features of First Embodiment

Figure 8:
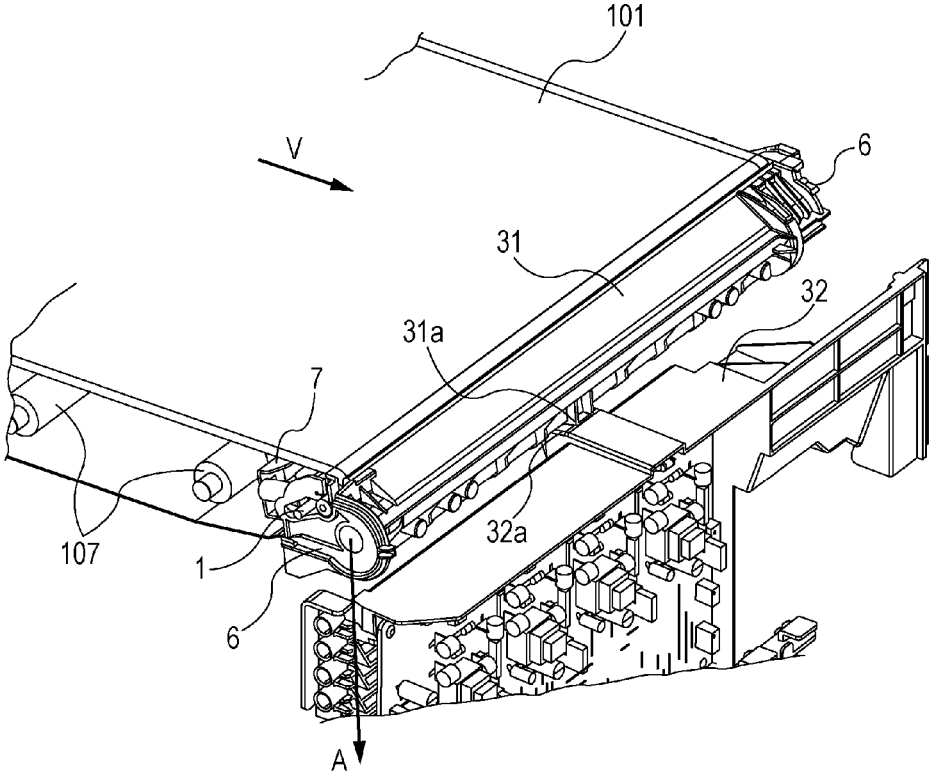
FIG. 8 is a perspective view of a second supporting member according to a first embodiment.
Figure 9:
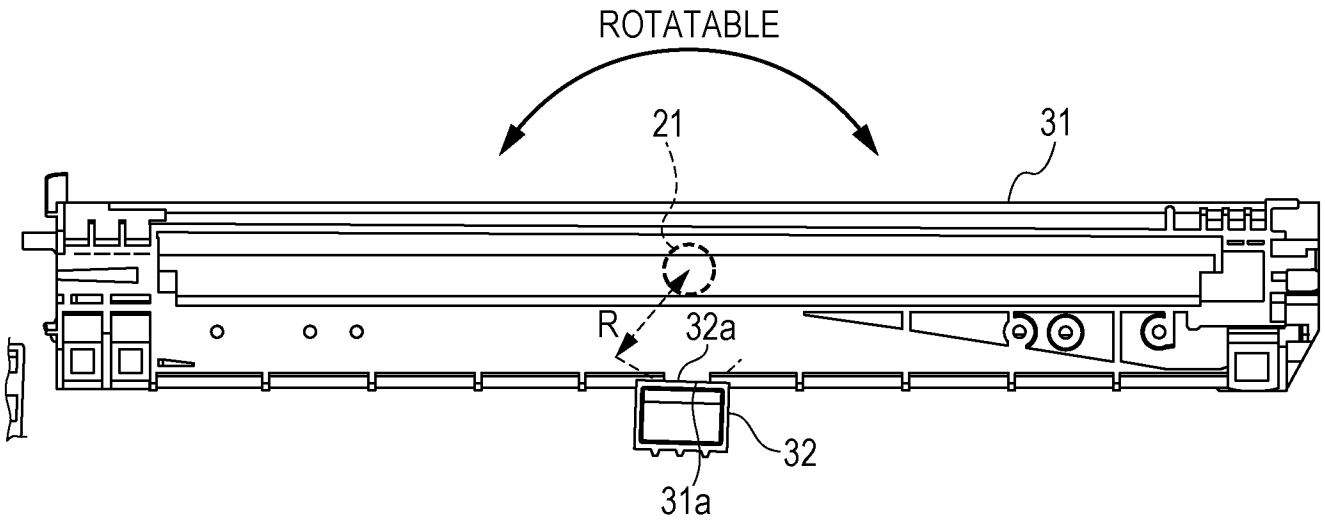
FIG. 9 is an explanatory view of movement of the second supporting member at the time of steering action.
Figure 10A:
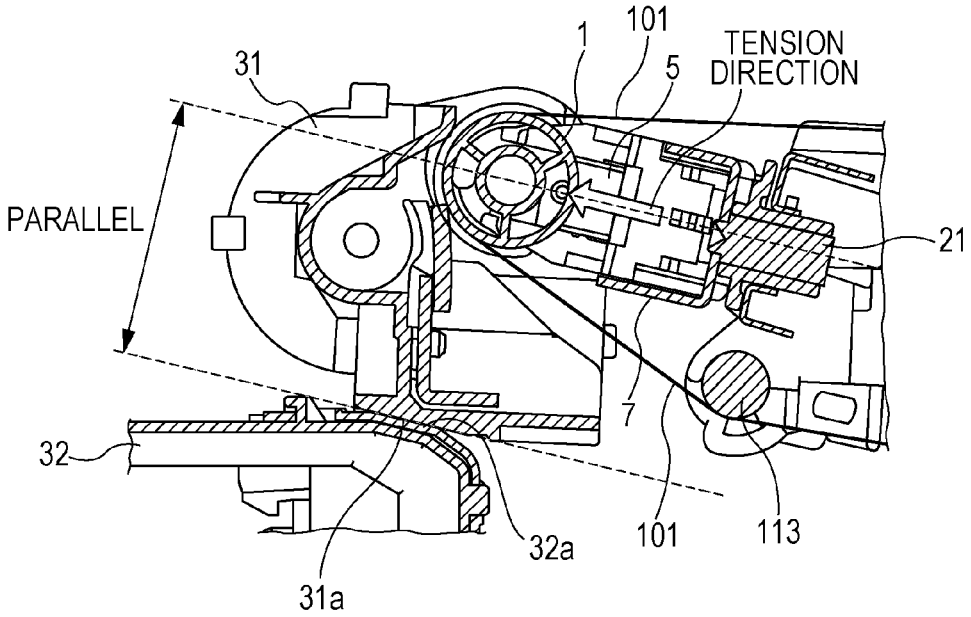
FIGS. 10A and 10B are explanatory views of the relation of the direction of applying tensile force and the sliding direction of the second supporting member.
Figure 10B:
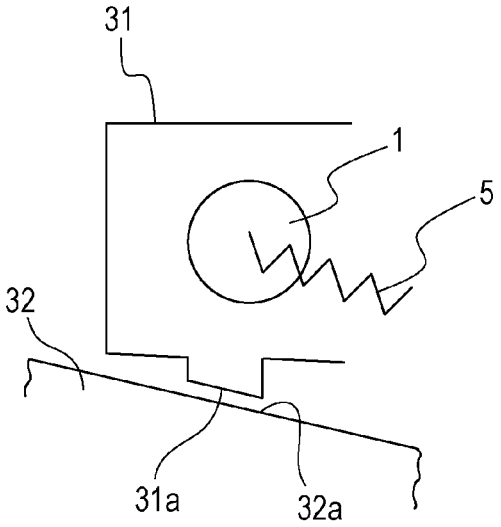

FIG. 8 is a perspective view of a second supporting member according to a first embodiment. FIG. 9 is an explanatory view of movement of the second supporting member at the time of steering action. FIGS. 10A and 10B are explanatory views of the relation of the direction of applying tensile force and the sliding friction direction of the second supporting member.

As illustrated in FIG. 1, the steering roller 1 is stretched over the intermediate transfer belt 101 at a position separated from the driving roller 110, and rotates following the intermediate transfer belt 101. As illustrated in FIGS. 7A and 7B, the cleaning blade 102*b* which is an example of the sliding friction member sandwiches the intermediate transfer belt 101 between the sliding friction member and the steering roller 1, and generate sliding friction.

As illustrated in FIG. 5, the side supporting member 6 which is an example of the steering roller supporting portion supports the end portions of the steering roller 1 so as to be movable in the tensile force direction of the intermediate transfer belt 101. The tension spring 5, which is an example of an urging member, urges the pair of side supporting member 6 to the respective tensile force direction thereof. As illustrated in FIGS. 7A and 7B, the belt cleaning device 102 which is an example of a cleaning unit, cleans the intermediate transfer belt 101 with the cleaning blade 102*b*, which is an example of a cleaning member, at a position facing the steering roller.

As illustrated in FIG. 4, the rotating shaft 21, which is an example of the first supporting mechanism, is disposed on the frame stay 8, and tiltably supports the steering roller 1 and belt cleaning device 102 in the periphery of a predetermined rotational axis that is perpendicular to the rotational axis of the steering roller 1.

As illustrated in FIG. 9, a backup face 32*a*, which is an example of the second supporting mechanism, tiltably supports the belt cleaning device 102 in the periphery of a predetermined rotational axis, so as to reduce the force applied to the rotating shaft 21 corresponding to the movement of the intermediate transfer belt 101.

As illustrated in FIG. 8, a backup reception part 31*a*, which is an example of the belt side supporting unit, is disposed on the downward face of the belt cleaning device 102. The backup reception part 31*a* tilts in an integrated manner with the intermediate transfer belt 101 and the cleaning blade 102*b* in the periphery of a predetermined rotational axis.

The backup face 32*a*, which is an example of the housing side supporting unit, is disposed on the control box 32, which is an example of an upward face that is fixed to the housing structure of the image forming apparatus 100. The backup face 32*a* makes contact with the backup reception part 31*a* and supports the steering roller 1 and belt cleaning device 102. The backup reception part 31*a* and backup reception part 32*a* are formed so as to be parallel to a predetermined rotational axis, whereby even if the steering roller 1 moves in the direction of tensile strength being applied, force can be distributed while the predetermined contact state is maintained. The backup reception part 31*a* and backup reception part 32*a* are a pair of sliding friction faces on which is disposed a friction resistant resin material.

As illustrated in FIG. 1, the control box 32 is affixed to the main body frame. As illustrated in FIG. 8, the control box 32 is formed with a metal plate that also serves as a magnetic shield, and that contains a power source device, high voltage plate, control substrate, signal processing circuit, and the like. The backup face 32*a* is formed on the upper face of the control box 32 so as to abut against the backup reception part 31*a* of the toner collection container 31. The backup reception part 31*a* of the toner collection container 31 and the backup reception part 32*a* of the control box 32 have the positional relationship and the rigidity to abut and carry a load. The backup reception part 31*a* and backup face 32*a* abut against each other, and minutely slide in the circumferential direction where the rotation shaft 21 is the center, and the rotational axis direction of the rotating shaft 21, and therefore are formed with a polyacetal resin (POM) or fluoro plastic (FRP) or the like having slidability. Thus, the tiltable feature of the steering roller 1 that is needed for the autonomous steering of the intermediate transfer belt 101 is not lost.

As described above, the cleaning blade 102*b* receives force in the moving direction of the intermediate transfer belt 101 at the abutting portion, and force in the arrow A direction of the steering roller 1 is applied via the belt cleaning device 102 and slide bearing 4. At this time, the force in the arrow A direction is transmitted from the backup reception part 31*a* of the belt cleaning device 102 to the backup face 32*a* of the control box 32, whereby load increases of the rotating shaft 21 and frame stay 8 are reduced.

As illustrated in FIG. 9, the backup face 32*a* of the control box 32 is an upward facing concave circular face of the curvature radius R2 where the rotating shaft 21 is the center thereof. The backup reception part 31*a* and backup face 32*a* are formed generally on the same axis as the steering roller 1 and the rotating shaft 21 which turnably supports the turning plate 7. The backup reception part 31*a* of the belt cleaning device 102 is a downward facing convex circular face of a curvature radius al which is slightly smaller than the curvature radius R2 which forms a peak in the distance R2 from the rotating shaft 21.

$\alpha 1 > \alpha 2$

As illustrated in FIG. 8, upon lateral movement occurring to the intermediate transfer belt 101, the steering roller 1 autonomously tilts to steer the intermediate transfer belt 101. As illustrated in FIG. 9, the backup reception part 31*a* causes sliding friction with the backup face 32*a* at a position near the rotating shaft 21, according to the tilting of the steering roller 1. At this time, the backup reception part 31*a* is a circular face on the same axis as the rotating shaft 21, whereby the backup reception face 31*a* and the backup face 32*a* maintain roughly the same contact state. As illustrated in FIGS. 7A and 7B, the steering roller 1 can be inhibited from tilting in the arrow A direction without applying turning resistance on the steering action of the steering roller 1.

As illustrated in FIG. 10A, the backup reception part 31*a* of the belt cleaning device 102 and the backup face 32*a* of the control box 32 are formed parallel to the direction that the tension spring 5 urges and moves the steering roller 1. The backup reception part 31*a* of the belt cleaning device 102 and the backup face 32*a* of the control box 32 are formed parallel to the rotating shaft 21 of the turning plate 7.

Note that the backup face 32*a* which is provided to the main body side of the image forming apparatus 100 is not restricted to being on a control box (power source box, plate holder), and may be formed on the main body frame that makes up the image forming apparatus 100, or may be provided another part.

Advantages of First Embodiment

As illustrated in FIG. 3, according to the first embodiment, an autonomous steering method is used, wherein the steering roller 1 performs lateral movement control of the intermediate transfer belt 101 automatically based on left and right balance of frictional force. The left and right balance of frictional force of the steering roller 1 generates mechanical feedback, and lateral movement occurs to the intermediate transfer belt 101, upon which the steering roller 1 autonomously tilts and cancels the lateral movement. The mechanical feedback does not use a motor, so power consumption from the lateral control of the intermediate transfer belt 101 is nil. The autonomous steering method is a simple and low-cost belt lateral control method in which the number of parts used is few.

A sensor to detect lateral movement of the intermediate transfer belt 101, a control unit to compute the tilting amount of the steering roller 1 based on the output of the sensor and operate the motor, and a driving transmittance mechanism to convert the rotation angle of the motor into a tilting amount of the steering roller 1 are all unnecessary. Accuracy of lateral control is not related to detecting accuracy of the lateral amount by the sensor. Also, unnecessary lateral movement of the intermediate transfer belt 101 resulting from a sudden output change from the sensor, causing the intermediate transfer belt 101 to meander, does not occur.

As illustrated in FIG. 8, according to the first embodiment 1, a backup reception part 31*a* is provided at roughly the center, near the rotating shaft 21 of the steering roller 1, and a backup face 32*a* that abuts against the backup reception part 31*a* is formed on the main body side of the image forming apparatus 100. By providing the backup reception part 31*a* as a circular face on the same axis as the rotating shaft 21, deformity in the steering roller 1 and turning plate 7 can be suppressed as to force in the conveyance direction of the intermediate transfer belt 101, without influencing the steering action of the steering roller 1.

As illustrated in FIG. 7, according to the first embodiment, in the case of downward force being generated on the steering roller 1, the backup face 32*a* supports the backup reception part 31*a*. Therefore, in the case that sliding friction resistance of the cleaning blade 102*b* changes and force in the arrow A direction changes greatly, the belt cleaning device 102 can be inhibited from vibrating and generating a vibration noise, or from markedly drooping and preventing the transfer of toner images in the primary transfer unit. Even if the force in the arrow A direction increases, the turning plate 7 that supports the steering roller 1, the rotating shaft 21, rotary damper 20, and frame stay 8 can be prevented from being displaced or deformed.

According to the first embodiment, even in the case that the steering roller 1 receives force in the movement direction of the intermediate transfer belt 101, desired tension can be applied to the intermediate transfer belt 101, and image distortion does not readily occur. Even in the case wherein a large force is applied in the movement direction of the intermediate transfer belt 101, the steering action of the autonomous steering method is not inhibited and the steering roller 1 and the supporting configuration thereof do not readily tilt, whereby stable belt conveyance can be realized. The configuration wherein the backup reception part 31*a* and the backup face 32*a* are abutted against each other does not have to provide a large space between these and the peripheral parts, whereby the size of the image forming apparatus can be reduced.

Second Embodiment

Figure 11A:
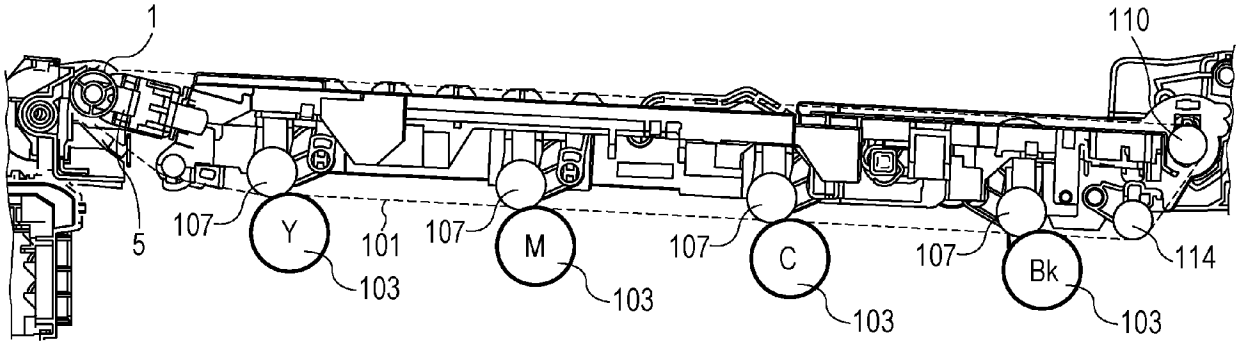
FIGS. 11A and 11B are explanatory views of a supporting structure of a belt cleaning device according to a second embodiment.
Figure 11B:
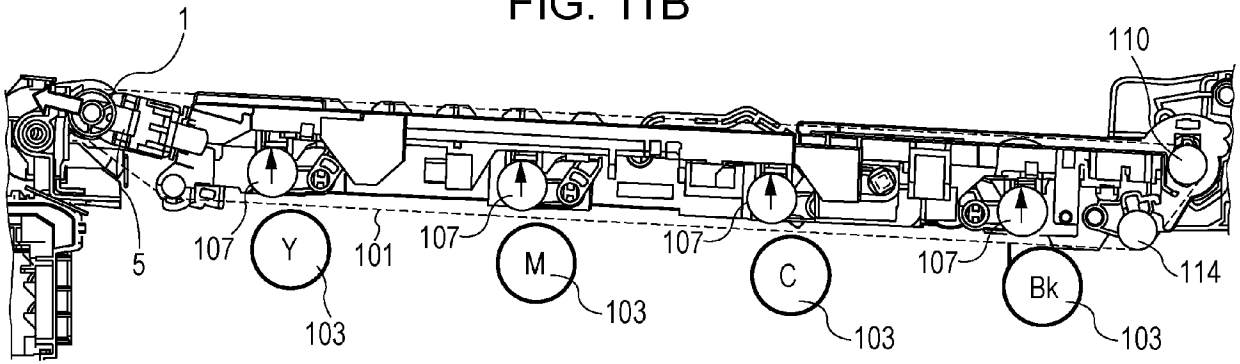

FIGS. 11A and 11B are explanatory views of a supporting structure of a belt cleaning device according to a second embodiment. As illustrated in FIGS. 11A and 11B, multiple photosensitive drums 103, which are an example of an image bearing member, come into contact with the intermediate transfer belt 101. A contact and separating mechanism moves the intermediate transfer belt 101 and causes the intermediate transfer belt 101 to abut against and separate from the photosensitive drums 103. The contact length of the backup reception part 31*a* and backup face 32*a* is longer than the moving length that follows a predetermined rotational axis of the steering roller 1 which follows the action of the contact and separating mechanism.

As illustrated in FIG. 11A, when in full-color mode, the four color toner images have to be transferred onto the intermediate transfer belt 101, so all four colors of photosensitive drums 103 (Y, M, C, Bk) are brought into contact against the intermediate transfer belt 101. At this time, the intermediate transfer belt 101 is pressed downward by the primary transfer roller 107 (Y, M, C, Bk), whereby the tension spring 5 contracts and the steering roller 1 moves toward the secondary transfer inner roller 110 side.

On the other hand, when in black monochrome mode, the black photosensitive drum 103 (Bk) is brought into contact against the intermediate transfer belt 101, but the photosensitive drums 103 of the remaining three colors (Y, M, C) are separated from the intermediate transfer belt 101. This is to avoid unnecessary abrasion of the photosensitive drums 103 (Y, M, C) and to extend the replacement life thereof. At this time, the primary transfer rollers 107 (Y, M, C) move upward, and is not pressing downward on the intermediate transfer belt 101, the tension spring 5 stretches, the steering roller 1 moves toward the outside, and slack in the intermediate transfer belt 101 is absorbed.

As illustrated in FIG. 11B, when replacing the intermediate transfer belt 101, the tension roller 114, in addition to the primary transfer rollers 107 (Y, M, C, Bk), is moved upwards, whereby maximum slack occurs in the intermediate transfer belt 101. At this time, the tension spring 5 further expands and the steering roller 1 moves toward the outside, and slack in the intermediate transfer belt 101 is absorbed.

In these cases, the backup reception part 31*a* and backup face 32*a* are disposed parallel to the moving direction of the steering roller 1, whereby the backup reception part 31*a* and backup face 32*a* smoothly cause sliding friction, and slack is not generated in the intermediate transfer belt 101.

Third Embodiment

Figure 12:
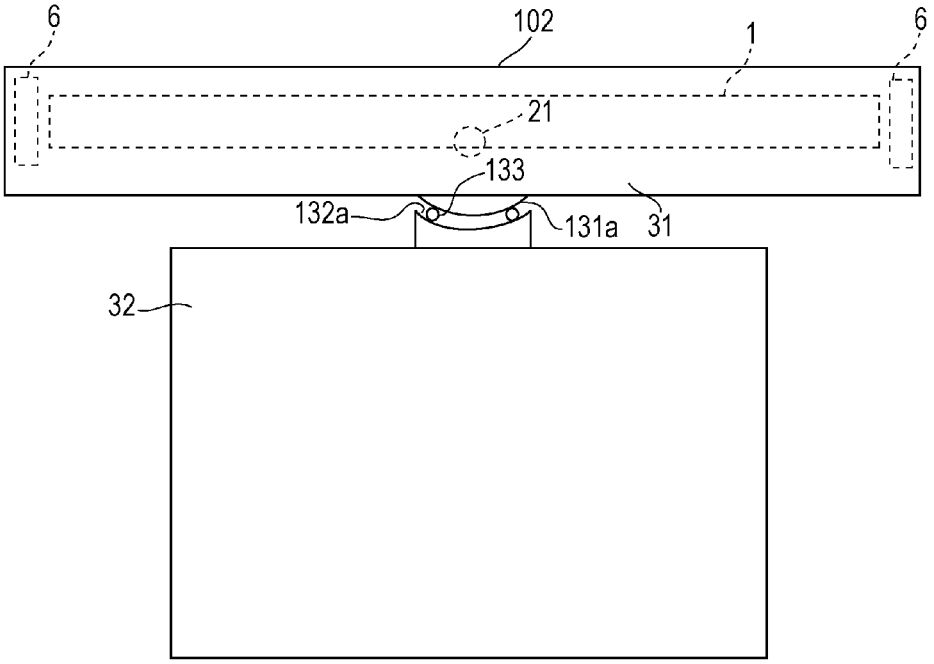
FIG. 12 is an explanatory view of a supporting structure of a belt cleaning device according to a third embodiment.

FIG. 12 is an explanatory view of a supporting structure of a belt cleaning device according to a third embodiment. According to the first embodiment, the backup reception part 31*a* and backup face 32*a* are configured in a combination of circumferential face and circumferential face, but the present invention is not restricted to the combination of circumferential face and circumferential face. A combination of a curved plane and a flat plane, or a flat plane and a flat plane, may also be used.

As illustrated in FIG. 12, according to the third embodiment, the backup face 32*a*, which is an example of one of the facing faces, is formed in a partial cylinder having a predetermined rotational axis as the center axis thereof. The backup reception part 31*a*, which is another example of a facing face, has a rolling member that serves as a guide towards the backup face 32*a*.

A backup receiving part 131*a* of the toner collection container 31 and the backup face 132*a* of the control box 32 abut against each other via a roller 133. The roller 133 is rotatably attached to the backup face 132*a* with an unshown rotating shaft. The backup receiving part 131*a* of the toner collection container 31 is formed so as to be an envelope circumferential face on the inner side of the roller 133, the center of which is the rotating shaft 21 of the steering roller 1.

Note that the roller 133 may be attached to the backup reception part 131*a* of the toner collection container 31, so that the backup face 132*a* of the control box 32 is formed into an envelope circumferential face on the outer side of the roller 133.

Fourth Embodiment

Figure 13A:
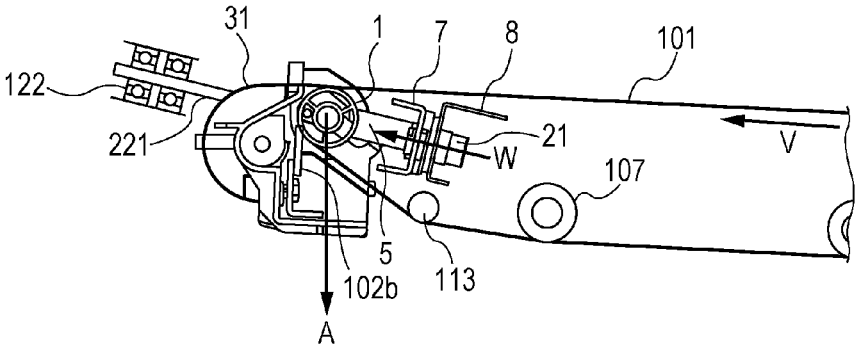
FIGS. 13A and 13B are explanatory views of a supporting structure of a belt cleaning device according to a fourth embodiment.
Figure 13B:
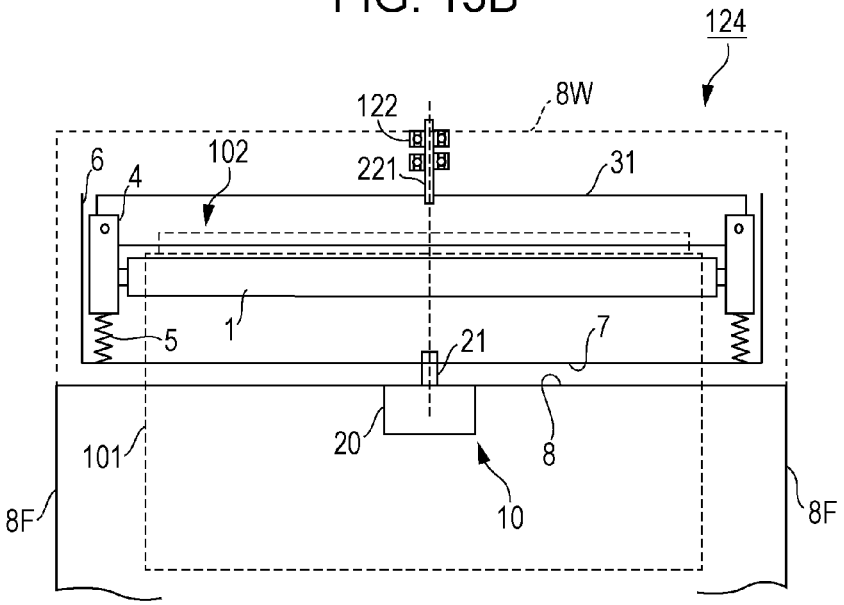

FIGS. 13A and 13B are explanatory views of a supporting structure of a belt cleaning device according to a fourth embodiment. According to the first embodiment, the bottom face of the toner collection container 31 is configured so as to abut against an upward face and to be supported from below, but the present invention is not restricted to a configuration that abuts and supports a face with another face. The belt cleaning apparatus 102 may be supported by being suspended from above. The supporting configuration is not restricted to the housing of the image forming apparatus, and a frame configuration may be used for the intermediate transfer unit instead.

As illustrated in FIG. 13A, according to the fourth embodiment, a supporting shaft 221 is attached to the toner collection container 31 on generally the same axis as the rotation shaft 21. The supporting shaft 221 is rotatably supported by the bearing 122 which is attached to the frame of the image forming apparatus 100. The bearing 122 is supported to have a small amount of slip in the horizontal direction, so free extension and contraction of the left and right tension springs 5 are not prevented.

Note that, as illustrated by the broken lines, the bearing 122 may support the frame 8W which extends from the side plate 8F of the intermediate transfer unit 124. The abutting surface of the toner collection container 31 may be disposed on the frame 8W, or the toner collection container 31 may be suspended and supported from the frame 8W. In either configuration, the toner collection container 31 is supported by the frame 8W, whereby bending momentum applied to the rotating shaft 21 is reduced, and load on the turning plate 7 and frame stay 8 and so forth is reduced.

Fifth Embodiment

The present invention can be carried out, even if a portion or all of the configurations of the embodiments are replaced with embodiments having alternative configurations, as long as a steering roller that autonomously performs lateral control of a belt member without being driven, is turnably supported in two or more locations.

Accordingly, as long as the image forming apparatus uses an autonomous belt member lateral control, any of a tandem type or one-drum type, an intermediate transfer type or recording medium conveying type may be used. The belt member may be a transfer belt or a fixing belt other than the intermediate transfer belt.

The present invention can inhibit the steering roller 1 and the supporting base thereof from moving downward or vibrating, even in the case of a great downward force being applied to the intermediate transfer belt 101 from a cause other than the cleaning blade 102*b*. As illustrated in FIG. 3, the sliding ring portion 3, which is an example of the sliding friction member, is disposed on both end portions of the steering roller 1, following rotation as to the intermediate transfer belt 101 is restricted, and sliding friction occurs to the edge regions of the intermediate transfer belt 101. In the event that driving is input into the driving roller 110 of the intermediate transfer belt 101 and the intermediate transfer belt 101 begins rotating, force is applied in the movement direction of the intermediate transfer belt 101 in order to overcome the static friction force.

In this sort of case also, by the first supporting mechanism and second supporting mechanism sharing the force, the rotation shaft is supported on both sides, whereby distortion and stress are reduced, and the steering roller 1 does not tilt together with the supporting base thereof.

The present embodiments have described only the main components relating to forming and transferring a toner image, but the present invention can be used in various types of ways such as in printers, various types of printing devices, photocopiers, facsimiles, multifunction devices, and so forth, by adding on necessary devices, attachments, and housing structures.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-052679 filed Mar. 15, 2013, which is hereby incorporated by reference herein in its entirety.

What is claimed is:

1. An image forming apparatus comprising:

a belt unit, including, a belt member, a steering unit, and a tilting shaft, the belt member configured to be moved in a moving direction and bear toner images, the steering unit, configured to be tilted in a belt unit for moving a position of the belt member with respect to a width direction crossing the moving direction, including, a steering roller, a cleaning blade, a supporting member, and a first abutted portion, the steering roller configured to rotatably stretch the belt member and to be tilted, the cleaning blade, configured to abut the surface of the belt member at a position facing the steering roller across the belt member for removing toner, the cleaning blade being applied a frictional force caused by moving of the belt member in the moving direction, the supporting member configured to support the steering roller and the cleaning blade in a body, the first abutted portion disposed at an outer surface of the steering unit, the tilting shaft configured to rotatably support the steering unit, a direction of the tilting shaft being perpendicular to a direction of an axis of the steering roller, and a second abutted portion, disposed at a position facing the first abutted portion, configured to receive an applied force to the first abutted portion caused by the frictional force during moving of the belt member in the moving direction.

2. The image forming apparatus according to claim 1, the supporting member further comprising a housing portion which supports the cleaning blade.

3. The image forming apparatus according to claim 1, the belt unit further comprising a unit frame, the unit frame supports the tilting shaft.

4. The image forming apparatus according to claim 1, the belt unit further comprising a pair of slidable bearing member, and an urging unit, a shaft of the steering roller is supported with the pair of slidable bearing member at an end portion of the steering roller, the steering roller is urged by the urging unit to stretch the belt member.

5. The image forming apparatus according to claim 1, the belt unit is attachable to and detachable from the main body.

6. The image forming apparatus according to claim 1, the tilting shaft is disposed at a central portion of the belt member with respect to the width direction.

7. The image forming apparatus according to claim 6, the first abutted portion and the second abutted portion are disposed at a position corresponding to the tilting shaft with respect to the width direction.

8. The image forming apparatus according to claim 1, the tilting shaft is substantially parallel to both a surface of the first abutted portion and a surface of the second abutted portion.

9. The image forming apparatus according to claim 1, the main body further comprising a frame, the second abutted portion is disposed at an outer surface of the frame.

10. The image forming apparatus according to claim 1, the steering roller comprising a rotation portion in a central part and a pair of non-rotation portion in an outer side of the rotation portion with respect to the width direction.

11. The image forming apparatus according to claim 1, wherein the first abutted portion and the second abutted portion are arranged coaxially with the tilting shaft.

12. The image forming apparatus according to claim 1, wherein at least one of the first abutted portion and the second abutted portion is formed having a partial cylindrical face.

13. The image forming apparatus according to claim 1, wherein at least one of the first abutted portion and the second abutted portion is formed having a sliding friction face made of a friction resistant resin material.

14. The image forming apparatus according to claim 1, wherein at least one of the first abutted portion and the second abutted portion is formed having a rolling member.

* * * * *